United States Patent [19]

Howard

[11] 3,983,646

[45] Oct. 5, 1976

[54] CHIP STRUCTURE

[75] Inventor: Robert Howard, Windham, N.H.

[73] Assignee: Gamex Industries Inc., Las Vegas, Nev.

[22] Filed: Aug. 8, 1974

[21] Appl. No.: 495,679

[52] U.S. Cl. ..... 40/27.5
[51] Int. Cl.[2] ..... G09F 3/02
[58] Field of Search ..... 40/27.5, 2.2; 273/137 R, 137 W

[56] References Cited

UNITED STATES PATENTS

| | | | |
|---|---|---|---|
| 2,196,850 | 4/1940 | Bostian | 40/27.5 |
| 3,092,402 | 6/1963 | Reed | 273/152.1 |
| 3,280,489 | 10/1966 | Bergmann | 40/27.5 |
| 3,477,156 | 11/1969 | Naito | 40/2.2 |
| 3,766,452 | 10/1973 | Burpee | 40/27.5 |

FOREIGN PATENTS OR APPLICATIONS

| | | | |
|---|---|---|---|
| 1,001,412 | 10/1951 | France | 273/137 |

*Primary Examiner*—Louis G. Mancene
*Assistant Examiner*—Wenceslao J. Contreras
*Attorney, Agent, or Firm*—Ostrolenk, Faber, Gerb & Soffen

[57] ABSTRACT

A chip structure for use in gaming applications and the like which, while formed of a lightweight, inexpensive plastic, nevertheless is weighted with at least one metallic insert to provide the resultant chip with more "body." An annular ring is arranged around the periphery of the chip to facilitate the identification and presence of the chip through automated counting apparatus.

7 Claims, 11 Drawing Figures

FIG. 1.
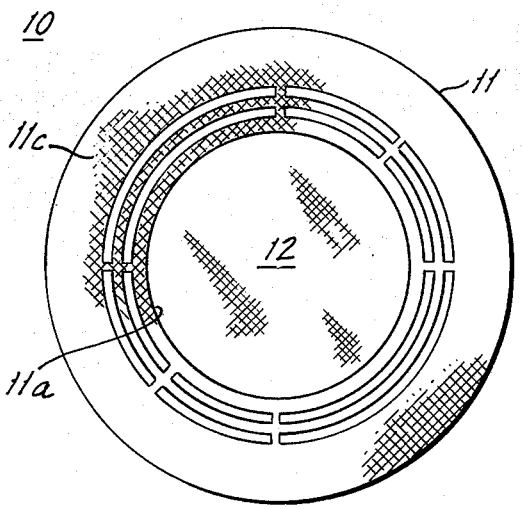
FIG. 1c.
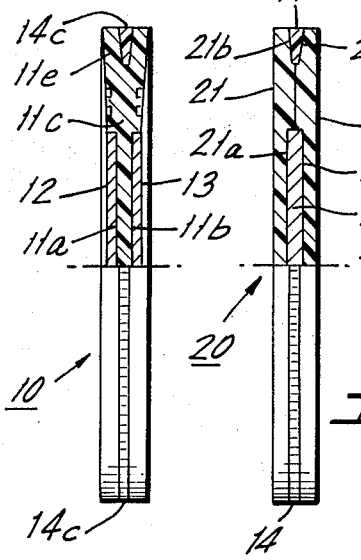
FIG. 3b.
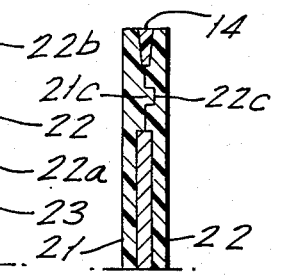
FIG. 3a.
FIG. 2a.
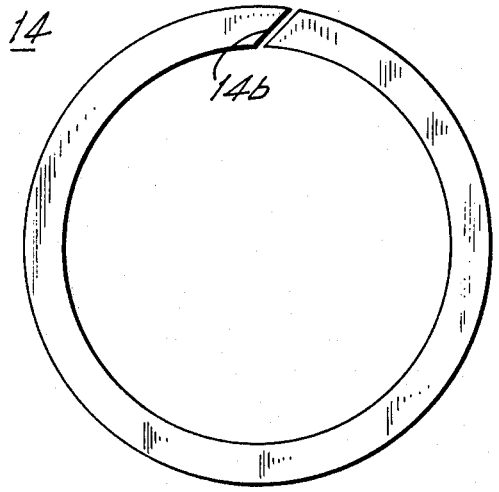
FIG. 2b.
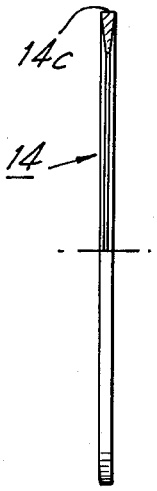
FIG. 2c.
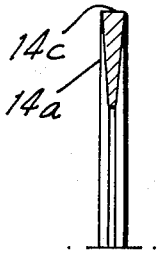
FIG. 4a.
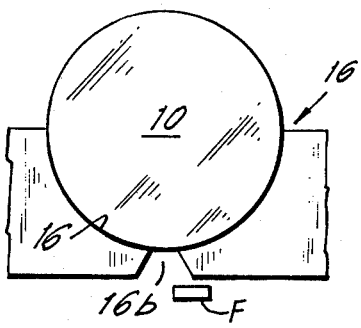
FIG. 1b.
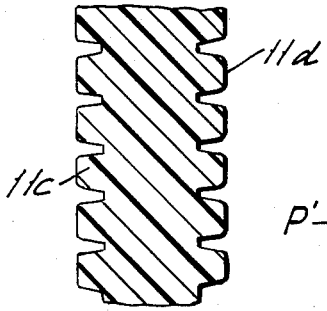
FIG. 4b.
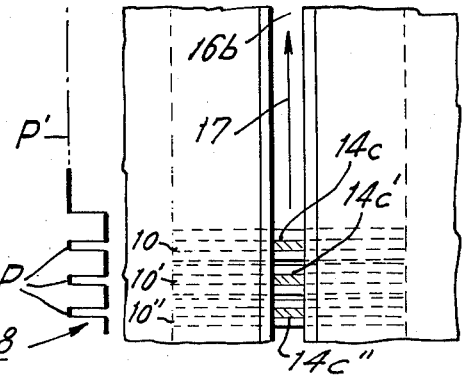
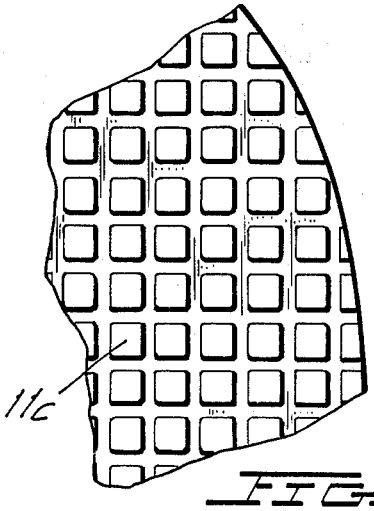
FIG. 1a.

CHIP STRUCTURE

The present invention relates to disc-shaped members and more particularly to a novel chip for use in gaming applications and the like which is appropriately weighted to provide the chip with more body and which has a fluorescing ring to facilitate identification of the presence of the chip by automated counting equipment.

BACKGROUND OF THE INVENTION

Gaming chips are typically employed in gaming facilities such as casinos and the like as a substitute for legal tender. Typically, a participant in a game converts legal tender into chips of one or more denominations with the chips received being provided with appropriate indicia to identify the particular casino and the denomination which the chip represents.

The dollar volume of chips taken in by a gaming casino over a set period such as a particular hour or day is determined by counting the total number of chips of each denomination, which operation is presently done manually wherein the denomination of the chip is determined by visual observation of appropriate indicia provided on each chip.

BRIEF DESCRIPTION OF THE INVENTION

The present invention is characterized by providing a novel chip structure which is inexpensive to manufacture due to the low cost of the components utilized to produce the chip and due to the ease of assembly. In addition thereto the chip is provided with an annular ring set into the periphery of the chip to facilitate identification and counting of the chip through the use of high speed automatic apparatus. The chip, in one preferred embodiment, is formed of a lightweight, inexpensive plastic material which is capable of being produced through inexpensive molding operations while providing a high quality chip of relatively tight tolerances. In order to provide a chip having substantial body at least one metallic insert is provided. An annular ring is set into the periphery of the chip and is formed of a plastic material admixed with a fluorescing substance adapted to emit light of a particular wavelength when exposed to light of a broad wavelength so as to be capable of being readily and easily counted through high speed automated apparatus.

BRIEF DESCRIPTION OF THE FIGURES AND OBJECTS

It is therefore one object of the present invention to provide a novel weighted chip structure having indicia bearing means for facilitating counting of the chip to high speed automated equipment.

Another object of the present invention is to provide a novel chip structure formed of inexpensive materials and yet having substantial body as well as an annular ring capable of fluorescing at a particular wavelength when exposed to light of a broad wavelength to facilitate counting of the chip by speed automated equipment.

The above as well as other objects of the present invention will become apparent when reading the accompanying description and drawings in which:

FIG. 1 shows a top plan view of a chip designed in accordance with the principles of the present invention.

FIG. 1*a* shows an enlarged plan view of a portion of the chip of FIG. 1 to indicate the surface texture thereof.

FIG. 1*b* shows an enlarged view of a section of the chip of FIG. 1, further indicating the nature of the surface texture of the chip.

FIG. 1*c* shows a sectional view of the chip of FIG. 1 taken along one diameter of the chip.

FIG. 2*a* shows a plan view of the ring insert employed in the chip of FIG. 1*c*.

FIG. 2*b* shows a partially sectionalized view of the ring of FIG. 2*a*.

FIG. 2*c* shows an enlarged view of the sectionalized portion of FIG. 2*b* to further facilitate an understanding of the structure.

FIG. 3*a* shows a sectional view taken along one diameter of another embodiment of a chip design in accordance with the principal of the present invention.

FIG. 3*b* is an enlarged sectional view of another embodiment similar to FIG. 3*a*.

FIGS. 4*a* and 4*b* show elevational and bottom plan views respectively of apparatus for automatically counting the chips of FIGS. 1–3.

DETAILED DESCRIPTION OF THE INVENTION

FIGS. 1–1*c* show a chip structure 10 comprised of a relatively thin circular-shaped disc body 11 preferably molded or otherwise formed from an inexpensive lightweight plastic material such as, for example, ZCETAL No. PDX 4090 manufactured by the Liquid Nitrogen Processing Corp. Any other plastic materials exhibiting the characteristic of being inexpensive, lightweight and having a capability of being easily and inexpensively molded into a disc-shaped member of relatively tight tolerances may be employed. The member 11 is provided with first and second shallow circular recesses 11*a* and 11*b* each respectively receiving a circular-shaped metallic disc 12 and 13 secured within the recesses by means of a suitable adhesive.

The annular shaped surfaces 11*c* and 11*d* surrounding each recess have a waffle-like pattern whose surface texture is shown best in FIG. 1*a* in which a portion of the surface is shown greatly enlarged. FIG. 1*b* shows a greatly enlarged cross-sectional view taken through the annular portion. The surface texture improves the aesthetic appearance of the chip as well as providing a surface which facilitates handling of the chip. The exterior surfaces of the metallic discs 12 and 13 have a brushed or matte like finish.

The periphery of the chip is provided with an inwardly tapering continuous groove 11*e* adapted to receive a ring insert 14 shown best in FIGS. 2*a*–2*c* and having a tapered cross-sectional configuration shown at 14*a* in FIG. 2*c*. Ring 14 is molded of a suitable plastic material such as, for example, Lexan which is homogeneously admixed with a pigment having the characteristic of emitting light of a predetermined wavelength when excited by a broad wavelength light source. Ring 14 is severed as shown at 14*b* to facilitate insertion of the ring into tapered groove 11e so as to provide a substantially continuous outer surface portion 14*c* which is substantially flush with the periphery of chip member 11.

The manner in which the chips may be automatically counted is shown best in FIGS. 4*a* and 4*b* wherein a chip tray 16 is shown as being provided with an arcuate shaped trough 16*a* for receiving a plurality of chips. The underside of the trough is provided with an opening 16*b* so as to expose a small arcuate portion of the periphery of each chip stacked within the trough. FIG. 4b shows a view of the underside of the chip tray. Three chips 10, 10′ and 10″ are shown stacked in the trough and having portions of the outer surfaces 14*c*, 14*c′* and 14*c″* exposed through opening 16b. One preferred technique for counting chips is to provide a suitable light source such as, for example, a black light which emit rays to excite the fluorescing pigments contained in the rings 14. These pigments emit light of a predetermined wavelength which is detected, for example, by a scanning device such as, for example, a TV camera adapted to scan the length of the elongated opening 16*b* in the direction shown by arrow 17 for the purpose of generating a signal such as waveform 18 shown in FIG. 4*b*. A light filter F is positioned between the scanning device and elongated opening 16*b* and is adapted to pass light lying within a narrow bandwidth, which bandwidth includes that wavelength of light emitted by the fluorescing material in ring 14. As the scanner scans across surfaces 14*c″*, 14*c′* and 14*c*, pulses P are generated indicating the presence of a chip. Since the ambient light passing through slit 16*b* in the region devoid of chips may contain the constituent wavelength, an output signal as shown by continuous elongated pulse P′ will be generated. However, this is clearly distinguishable from the individual pulses P arranged in spaced fashion to thereby assure accurate counting of the number of chips in the trough. The chip tray 16 may be provided with a plurality of preferably spaced parallel troughs to accommodate a large quantity of chips.

Chips of different denominations may be provided with bodies 11 of different colors and/or printed indicia may be provided on one or both surfaces of the chips. In addition thereto the pigments admixed with the ring 14 may be adapted to fluoresce at different predetermined wavelengths to provide means for automatically detecting the presence of chips of different denominations. In order to automatically count chips of different denominations, the filter F may be replaced by an indexable filter wheel provided with a quantity of filters equal in number to the total number of chip denominations. During each scan a different filter is indexed or otherwise moved so as to be positioned in front of the scanner so that only light of a predetermined wavelength will be passed. Upon the completion of each scan the filter wheel is indexed to position a filter which passes a different wavelength denomination and associated with a particular chip in front of the scanner. Thus, chips of different denominations may be indiscriminately stacked within trough 16*a* in any arrangement without affecting the accuracy of the count.

As another alternative, chips of different denominations may be stacked in different troughs allocated for each chip denomination. The chips may, for example, be color coded. When the scanner steps from one trough to the next chip count for each trough is transferred to a separate counter thereby providing an accurate count of the number of chips in each trough and, with knowledge of the denomination allocated to that trough, also provide a count of the total dollar volume of chips.

The use of metallic inserts 12 and 13 yields a chip of substantial body and cooperates with the surface texturing to facilitate handling of the chips.

FIG. 3*a* shows another preferred embodiment 20 of the present invention which is comprised of disc halves

21 and 22 each having a shallow recess 21*a* and 22*a* for receiving a single metallic insert 23. Halves 21 and 22 and metallic insert 23 are joined along their engaging surfaces by means of a suitable epoxy. Disc-shaped halves 21 and 22 are provided with continuous annular bevelled surfaces 21*b* and 22*b* which, when halves 21 and 22 are joined in the manner shown in FIG. 3*a*, collectively form an annular tapered groove for receiving insert ring 14. The embodiment 20 simplifies the insertion of ring 14 by eliminating the need for providing slit 14*b* (see FIG. 2*a*) since a ring may be placed between the two disc halves and glued into position substantially at the same time that the disc halves are joined to one another. Thus, the disc may be weighted appropriately while totally concealing the insert 23. This arrangement also eliminates the need for finishing insert 23 as well as reducing the number of inserts required. The nature and properties of the ring 14 are the same as those described in connection with the embodiment 10.

The plastic chip halves 21 and 22 may be provided with cooperating interfitting portions to enhance the joinder of the two members. For example, as shown in FIG. 3*b*, the interior surface of disc half 21 may be provided with a projection 21*c* which is adapted to fit within a groove 22*c* provided along the inner surface of disc half 22 and adapted to force fittingly receive projection 21*c*. The interfitted portions may consist of a series of cooperating pins and holes or may, for example, be a continuous annular projection adapted to be inner-fitted into a co-aligned continuous annular groove.

It can be seen from the foregoing description that the present invention provides a novel chip assembly for use in gaming applications and the like in which a chip is formed of relatively inexpensive materials which may be readily and simply assembled to provide a chip having substantial body and to provide means or indicia to facilitate automatic high speed counting of chips through the employment of a ring of fluorescing material.

Although there has been described a preferred embodiment of this novel invention, many variations and modifications will now be apparent to those skilled in the art. Therefore, this invention is to be limited, not by the specific disclosure herein, but only by the appending claims.

What is claimed is:

1. A chip structure being adapted to facilitate high speed counting of each individual chip structure even when arranged side by side in a stack, comprising:

a disc shaped plastic member;

the annular periphery of said member having a continuous groove;

an annular ring positioned in said groove with an outermost surface of said ring being visibly exposed along said periphery of said member, said ring being adapted to fluoresce and emit light of a predetermined wavelength when excited by a light source even if a discontinuity is present in said ring, the thickness of said disc member along the periphery thereof is greater than the width of said groove whereby the exposed surface of said ring insert defines a generally continuous visible annular stripe bounded on both sides thereof by the periphery of said plastic member wherein the periphery of each side of the annular stripe is nonfluorescing to facilitate identification of the presence of each and every chip structure in the stack.

2. The structure of claim 1 wherein said ring is comprised of a plastic material admixed with a fluorescing material and molded into a ring shaped configuration.

3. A chip structure for use in gaming applications and the like, comprising:

a disc shaped plastic member; the annular periphery of said member having a continuous groove; at least one surface of said member being provided with a shallow recess;

an annular ring positioned in said groove with an outermost surface of said ring being visibly exposed along the periphery of said member, said ring being adapted to fluoresce and emit light of a predetermined wavelength when excited by a continuous broad-spectrum light source even if there is a discontinuity in said ring;

a thin metallic member of substantially constant thickness and having a perimeter conforming to the perimeter of said recess and being secured in said recess to present a planar surface outward from said recess surface of said member; said insert member having a greater weight per unit volume than said plastic member to significantly increase the total weight of said structure and thereby provide the chip with more body.

4. A chip structure for use in gaming applications and the like, comprising:

a disc shaped plastic member; the annular periphery of said member having a continuous groove; each surface of said member being provided with a shallow recess;

an annular ring positioned in said groove with an outermost surface of said ring being visibly exposed along the periphery of said member, said ring being adapted to fluoresce and emit light of a predetermined wavelength when excited by a continuous broad-spectrum light source even if there is a discontinuity in said ring;

first and second thin metallic insert members each of substantially constant thickness and having a perimeter conforming to the perimeter of said recesses and being secured in said recesses to each present a planar surface outward from each said recess surface of said member; said insert member having a greater weight per unit volume than said plastic member to significantly increase the total weight of said structure and thereby provide the chip with more body.

5. A chip structure for use in gaming applications and the like, comprising:

a disc-shaped plastic member comprised of first and second disc halves; at least one of said halves having a shallow recess; the annular periphery of said member having a continuous groove;

adhesive means for securing said disc halves to one another whereby said recess and the confronting surface of the remaining chip half cooperatively form a hollow interior space;

a metallic insert member having a perimeter substantially conforming to the perimeter of said recess and positioned totally within and substantially filling said hollow interior space;

said adhesive means further being adapted to secure said insert member to said disc halves; said insert member having a substantially greater weight per unit volume than said disc member;

an annular ring positioned in said groove with an outermost surface of said ring being visibly exposed along said periphery of said member, said ring being adapted to fluoresce and emit light of a predetermined wavelength when excited by a continuous broad-spectrum light source even if there is a discontinuity in said ring.

6. A chip structure for use in gaming applications and the like, comprising:

a disc shaped plastic member comprised of first and second disc halves; each of said halves having a shallow recess; the annular periphery of said member having a continuous groove;

adhesive means for securing said disc halves to one another whereby said recesses cooperatively form a hollow interior space;

a metallic insert member having a perimeter substantially conforming to the perimeter of said recesses and positioned totally within and substantially filling said hollow interior space;

said adhesive means further being adapted to secure said insert member to said disc halves; said insert member having a substantially greater weight per unit volume than said disc member;

an annular ring positioned in said groove with an outermost surface of said ring being visibly exposed along said periphery of said member, said ring being adapted to fluoresce and emit light of a predetermined wavelength when excited by a continuous broad-spectrum light source even if there is a discontinuity in said ring.

7. The structure of claim 1 wherein said ring is adapted to fluoresce light of a different wavelength for each different denomination of said chip.

* * * * *